US008251448B2

(12) United States Patent
Machael et al.

(10) Patent No.: US 8,251,448 B2
(45) Date of Patent: Aug. 28, 2012

(54) DYNAMIC CHAIR BACK LUMBAR SUPPORT SYSTEM

(75) Inventors: Jay R. Machael, Muscatine, IA (US); Jesse Hahn, Cedar Rapids, IA (US); Corey Susie, Coralville, IA (US); Bruce Fifield, Milan (IT); Federico Ferretti, Cesena (IT); Alessandro Sgotto, Cologno Monzese (IT); Dagmara Siemieniec, Milan (IT); Martin Broen, Milan (IT)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 12/048,113

(22) Filed: Mar. 13, 2008

(65) Prior Publication Data

US 2008/0272636 A1 Nov. 6, 2008

Related U.S. Application Data

(60) Provisional application No. 60/894,659, filed on Mar. 13, 2007.

(51) Int. Cl.
*A47C 3/00* (2006.01)

(52) U.S. Cl. ..... 297/300.2; 297/299; 297/452.56

(58) Field of Classification Search ..... 297/284.4, 297/296, 297, 298, 299, 300.1, 300.2, 300.4, 297/452.56, 452.55, 301.1
See application file for complete search history.

(56) References Cited

U.S. PATENT DOCUMENTS 5,660,439 A * 8/1997 Unwalla ..... 297/316
5,810,440 A * 9/1998 Unwalla ..... 297/316
6,286,900 B1 9/2001 Roark
6,296,309 B1 * 10/2001 Kurtz ..... 297/297
6,367,876 B2 4/2002 Caruso et al.
6,367,877 B1 4/2002 Knoblock
6,394,545 B2 5/2002 Knoblock
6,568,760 B2 * 5/2003 Davis et al. ..... 297/440.14
(Continued)

FOREIGN PATENT DOCUMENTS

KR 1020030059582 A 7/2003
(Continued)

OTHER PUBLICATIONS

International Search Report and Written Opinion for PCT/US2008/056890 of HNI Technologies Inc., mailed Jul. 17, 2008.

*Primary Examiner* — David Dunn
*Assistant Examiner* — David E Allred
(74) *Attorney, Agent, or Firm* — Faegre Baker Daniels LLP

(57) ABSTRACT

A chair back according to embodiments of the present invention includes a rigid support member for reclinable attachment to a base, a flexible frame member having a flexible frame and a mesh, the mesh at least partially spanning the frame, and a seat attachment member moving in synchronization with the rigid support member at a different rate than the rigid support member during reclining of the rigid support member, wherein a first portion of the flexible frame member is affixed to the rigid support member, wherein a second portion of the flexible frame member flexes freely, wherein the seat attachment member contacts at least part of the second portion of the flexible frame member, wherein the first portion moves with the rigid support member and the second portion moves with the seat attachment member such that a curvature of the second portion increases as the rigid support member reclines.

14 Claims, 11 Drawing Sheets

U.S. PATENT DOCUMENTS

| | | | | |
|---|---|---|---|---|
| 6,572,190 | B2 | 6/2003 | Koepke | |
| 6,609,755 | B2 * | 8/2003 | Koepke et al. | 297/300.2 |
| 6,626,497 | B2 * | 9/2003 | Nagamitsu et al. | 297/452.15 |
| 6,669,292 | B2 * | 12/2003 | Koepke et al. | 297/300.2 |
| 6,729,691 | B2 | 5/2004 | Koepke | |
| 6,739,664 | B2 * | 5/2004 | Kinoshita et al. | 297/300.3 |
| 6,761,406 | B2 * | 7/2004 | Kinoshita et al. | 297/296 |
| 6,913,316 | B2 * | 7/2005 | Kinoshita et al. | 297/300.3 |
| 7,014,269 | B2 * | 3/2006 | Coffield et al. | 297/452.56 |
| 7,066,538 | B2 | 6/2006 | Machael et al. | |
| 7,134,722 | B2 * | 11/2006 | Ueda et al. | 297/301.1 |
| 7,600,814 | B2 * | 10/2009 | Link | 297/300.2 |
| 7,665,805 | B2 * | 2/2010 | Ueda | 297/301.6 |
| 7,712,833 | B2 * | 5/2010 | Ueda | 297/296 |
| 7,717,513 | B2 * | 5/2010 | Ueda | 297/300.2 |
| 7,726,740 | B2 * | 6/2010 | Masunaga | 297/303.3 |
| 7,997,652 | B2 * | 8/2011 | Roslund et al. | 297/300.2 |
| 8,029,060 | B2 * | 10/2011 | Parker et al. | 297/300.1 |
| 2002/0190552 | A1 | 12/2002 | Koepke | |
| 2002/0190553 | A1 * | 12/2002 | Koepke et al. | 297/300.2 |
| 2002/0190564 | A1 | 12/2002 | Koepke | |
| 2003/0001425 | A1 | 1/2003 | Koepke | |
| 2003/0075961 | A1 | 4/2003 | Struppler et al. | |
| 2003/0107252 | A1 * | 6/2003 | Kinoshita et al. | 297/301.1 |
| 2005/0093354 | A1 * | 5/2005 | Ball et al. | 297/284.4 |
| 2005/0121954 | A1 | 6/2005 | Coffield et al. | |
| 2005/0231013 | A1 | 10/2005 | Knoblock et al. | |
| 2005/0269848 | A1 | 12/2005 | Harley | |
| 2007/0108818 | A1 * | 5/2007 | Ueda et al. | 297/285 |
| 2007/0108821 | A1 * | 5/2007 | Ueda | 297/301.1 |
| 2011/0198909 | A1 * | 8/2011 | Fifield | 297/452.56 |
| 2011/0233979 | A1 * | 9/2011 | An | 297/284.4 |
| 2012/0007400 | A1 * | 1/2012 | Behar et al. | 297/284.4 |

FOREIGN PATENT DOCUMENTS

| | | | |
|---|---|---|---|
| WO | WO02102197 | A2 | 12/2002 |

* cited by examiner

DYNAMIC CHAIR BACK LUMBAR SUPPORT SYSTEM

CROSS-REFERENCE TO RELATED APPLICATIONS

This application claims the benefit of U.S. Provisional Patent Application Ser. No. 60/894,659, filed on Mar. 13, 2007, and entitled, "Dynamic Chair Back Lumbar Support System," which is incorporated by reference herein in its entirety.

TECHNICAL FIELD

Embodiments of the present invention relate generally to office furniture, and more specifically to a dynamic chair back lumbar support system therefor.

BACKGROUND

Current reclining chair designs often do not effectively match movement of a user with movement of the chair parts. For example, some chairs feature a reclining seat back coupled with a stationary seat, which does not permit the user's spine to conform to a natural position when reclining. As a user shifts a chair from an upright to a reclined position, a user's spine undergoes increased curvature, particularly in the lumbar region, which is often not addressed by chair backs which maintain the same shape throughout reclination. Therefore, there is a need in the art for an improved chair back design.

SUMMARY

A chair back according to some embodiments of the present invention includes a flexible frame portion configured for attachment to a seat and a rigid support member configured for pivotal attachment to a chair base, wherein a degree of curvature of the flexible frame portion increases dynamically as the rigid support member reclines about the chair base.

A chair back according to other embodiments of the present invention includes a rigid support member configured for reclinable attachment to a chair base, a flexible frame member including a flexible frame and a mesh element, the mesh element at least partially spanning the flexible frame, and at least one seat attachment member configured for coupling to a seat, the seat moving in synchronization with the rigid support member at a different rate than the rigid support member during reclining of the rigid support member. According to such embodiments, a first portion of the flexible frame member is affixed to the rigid support member, and a second portion of the flexible frame member flexes freely with respect to the rigid support member, such that the at least one seat attachment member contacts at least part of the second portion of the flexible frame member, and the first portion moves with the rigid support member and the at least part of the second portion moves with the seat attachment member such that a degree of curvature of the second portion increases as the rigid support member reclines. In some cases, the flexible frame is an inverted U-shaped frame. The seat attachment member may be rotatably or rigidly coupled with the flexible frame member; alternatively, the seat attachment member may be formed integrally with the flexible frame member or the seat. The flexible frame may be an outer frame, and the mesh element may be configured to contact a user's back. The free-flexing portion of the flexible frame member may be configured to provide support to a lumbar region of a user's back, and may be configured to dynamically adjust to match increasing curvature of a user's lumbar back region during reclining. A mesh element may be configured to at least partially span the flexible frame portion, and to contact a user's back. In some cases, the flexible frame portion is configured for attachment to the seat via a seat attachment member, and is configured to dynamically adjust to match increasing curvature of a user's lumbar back region during reclining.

A chair according to some embodiments of the present invention includes a base, a seat pivotably coupled to the base, a back including a rigid support member and a flexible frame member, the rigid support member pivotably coupled to the base, the flexible frame member coupled to the rigid support member and coupled to the seat, and a linkage assembly coupled to the back and to the seat, the linkage assembly configured to rotate the seat at least partially upwardly and at least partially toward the back during reclining of the back about the base, wherein a curvature of the flexible frame member increases as the back reclines about the base. The flexible frame member may be coupled to the seat by a seat attachment member, which may be a spring. The flexible frame member may be pivotably or rigidly coupled to the seat, and a mesh or polymer element may at least partially span the flexible frame member to contact a user's back, for example.

A chair back according to embodiments of the present invention includes a rigid support member configured for reclinable attachment to a chair base, a flexible frame member comprising a flexible frame and a mesh element, the mesh element at least partially spanning the flexible frame, and at least one seat attachment member coupled to a seat, the seat having a substantially fixed position with respect to the chair base, wherein a first portion of the flexible frame member is affixed to the rigid support member, wherein a second portion of the flexible frame member flexes freely with respect to the rigid support member, wherein the at least one seat attachment member contacts at least part of the second portion of the flexible frame member, and wherein the first portion moves with the rigid support member such that a degree of curvature of the second portion increases as the rigid support member reclines. In some cases, the seat attachment member is a spring. The flexible frame member may be pivotably or rigidly coupled with the seat attachment member, which may itself be a part of a core assembly or control assembly, according to embodiments of the present invention. A mesh and/or polymer element may at least partially span the flexible frame member.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
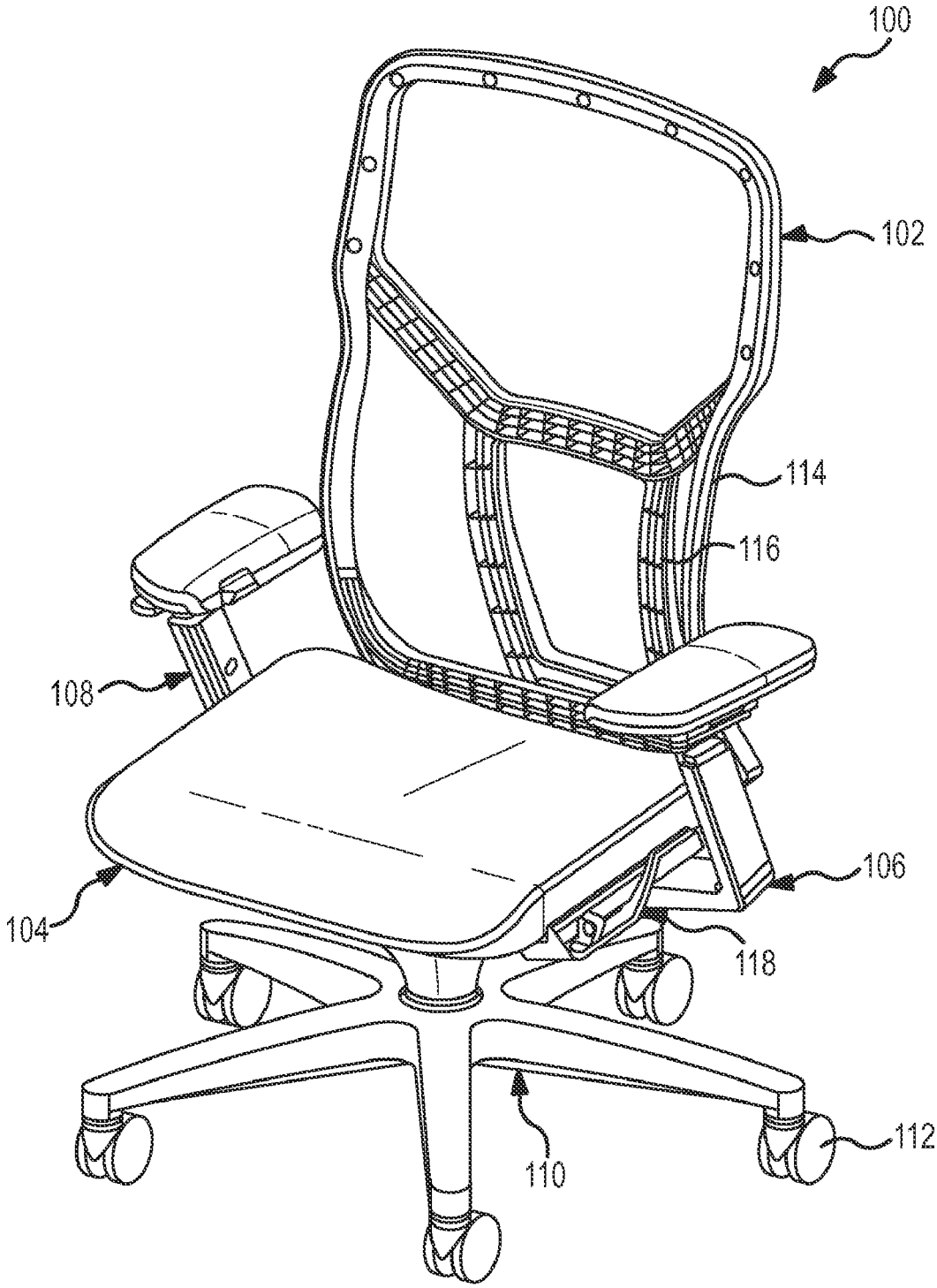
FIG. 1 illustrates a front perspective view of a chair according to embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Embodiments of the present invention relate generally to office furniture, and more specifically to a chair back which changes shape during reclination. FIGS. 1-7 depict a reclining office chair 100 according to embodiments of the present invention. Chair 100 includes a back 102, a seat 104, a left arm 106, a right arm 108, and a base pedestal 110. Seat 104 and back 102 of chair 100 rotate about base pedestal 110, and casters 112 or wheels may be coupled to base pedestal 110 to contact an underlying surface (such as, for example, a floor), according to embodiments of the present invention. Back 102 may include a support member 116 and a covering (not shown) made of mesh, fabric, polymer, plastic, or the like which is coupled to back 102 along outer frame 114 and against which a user's back would rest, according to embodiments of the present invention.

As used herein, the term "coupled" is used in its broadest sense to refer to elements which are connected, attached, and/or engaged, either directly or integrally or indirectly via other elements, and either permanently, temporarily, or removably. As used herein, the term "swivelably coupled" is used in its broadest sense to refer to elements which are coupled in a way that permits one element to swivel with respect to another element. As used herein, the terms "rotatably coupled" and "pivotably coupled" are used in their broadest sense to refer to elements which are coupled in a way that permits one element to rotate or pivot with respect to another element. As used herein, the term "slidably coupled" is used in its broadest sense to refer to elements which are coupled in a way that permits one element to slide or translate with respect to another element.

Figure 2:
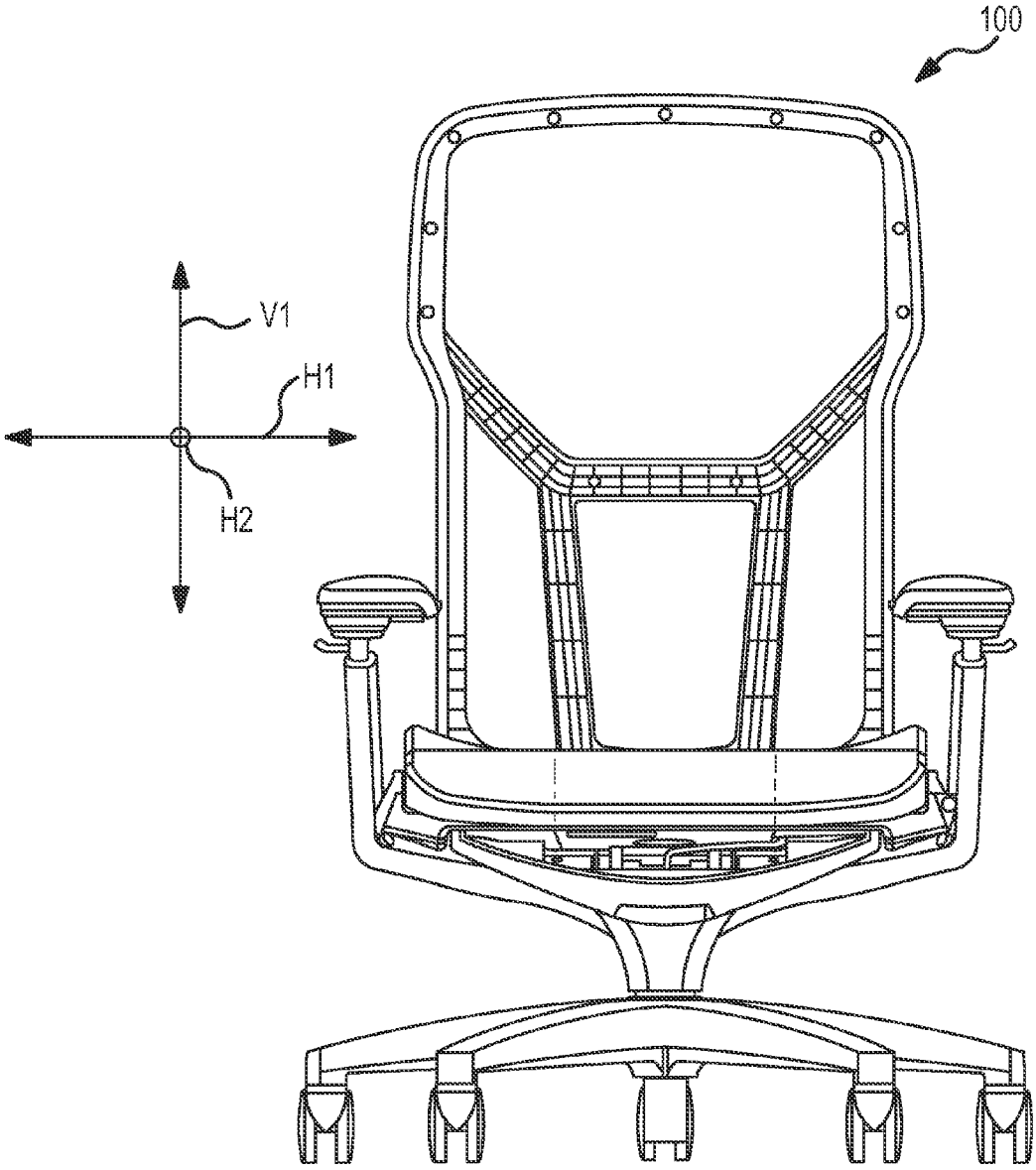
FIG. 2 illustrates a front view of the chair of FIG. 1, according to embodiments of the present invention.
Figure 3:
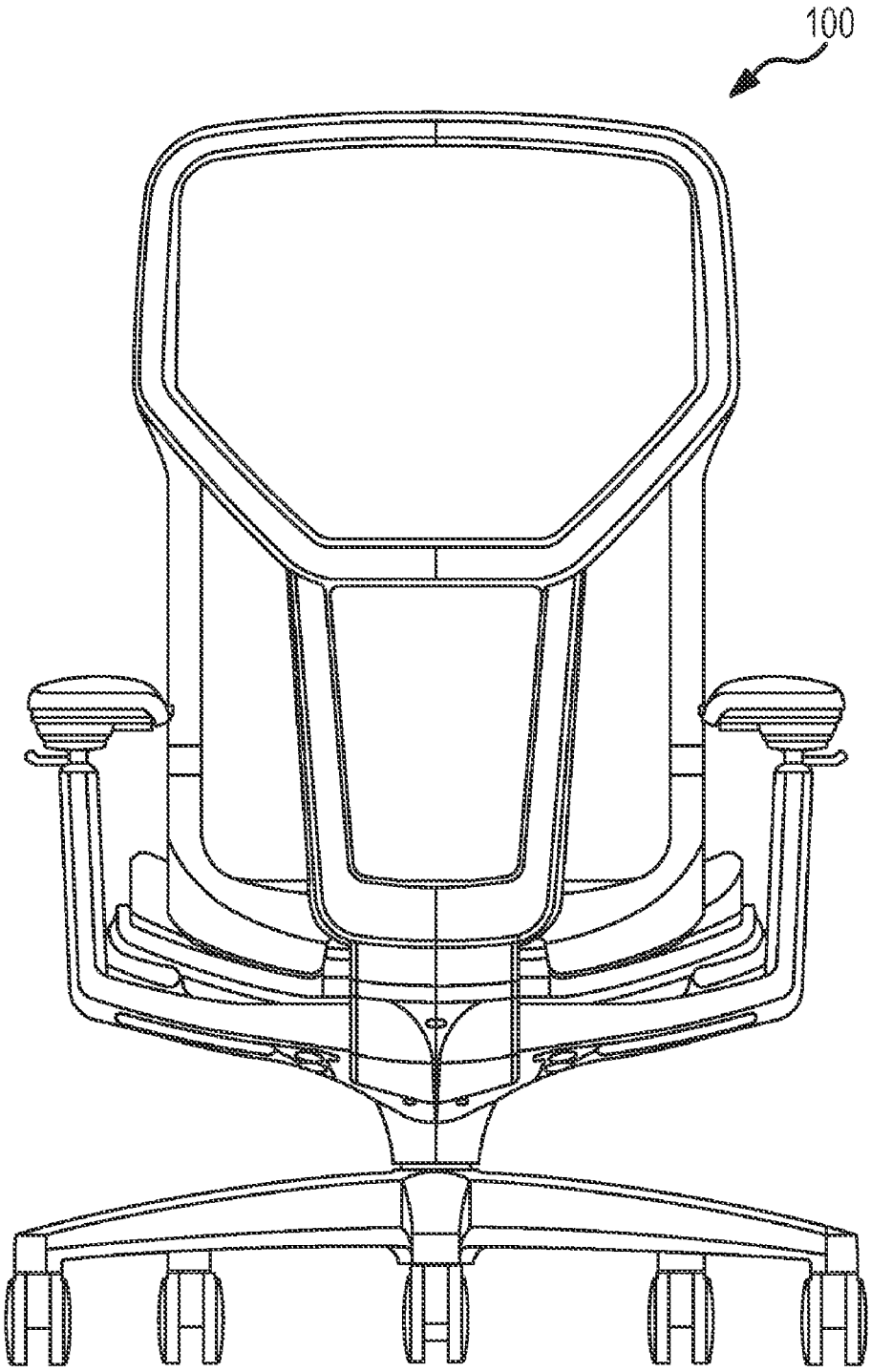
FIG. 3 illustrates a back view of the chair of FIGS. 1 and 2, according to embodiments of the present invention.
Figure 4:
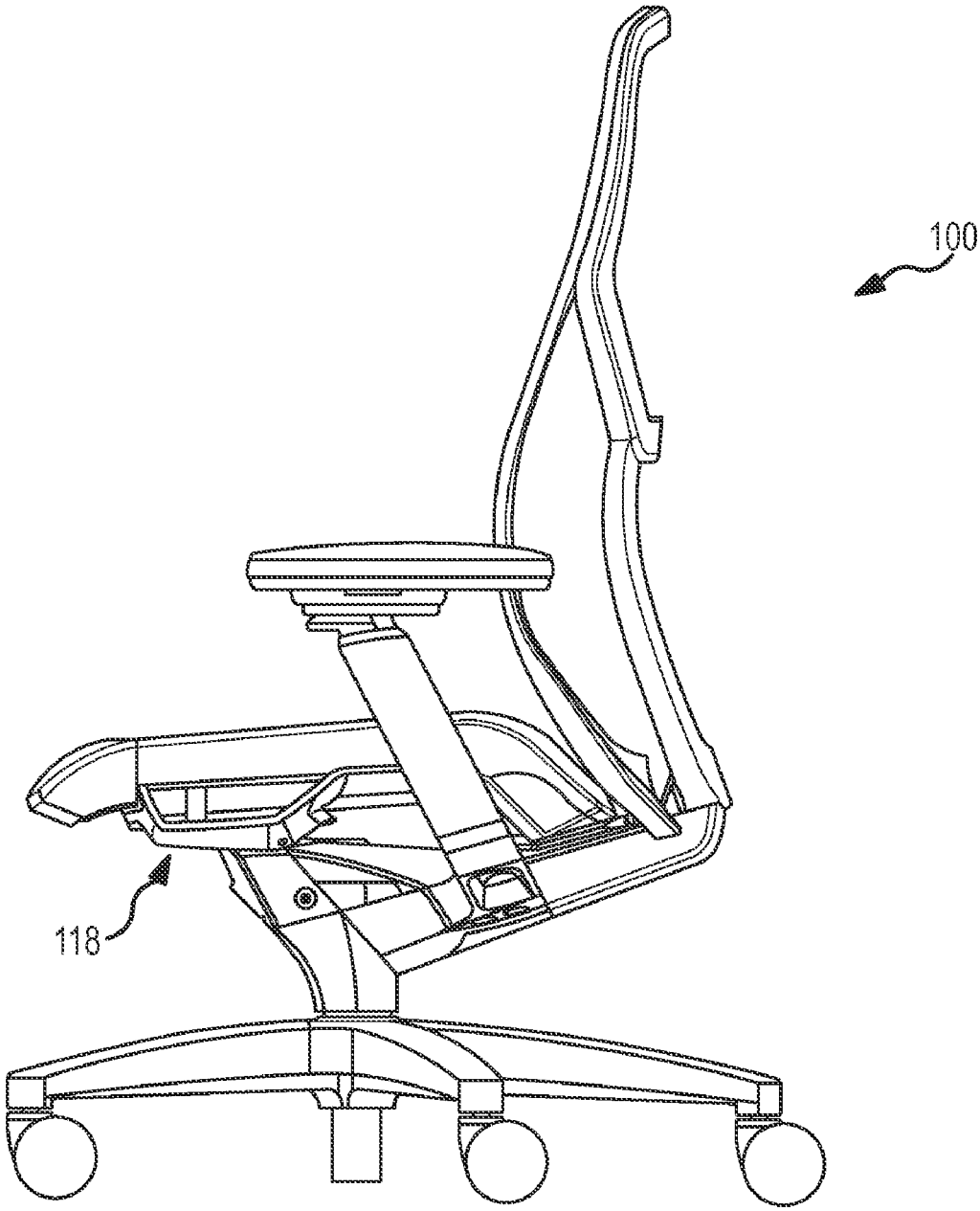
FIG. 4 illustrates a side view of the chair of FIGS. 1-3, according to embodiments of the present invention.
Figure 5:
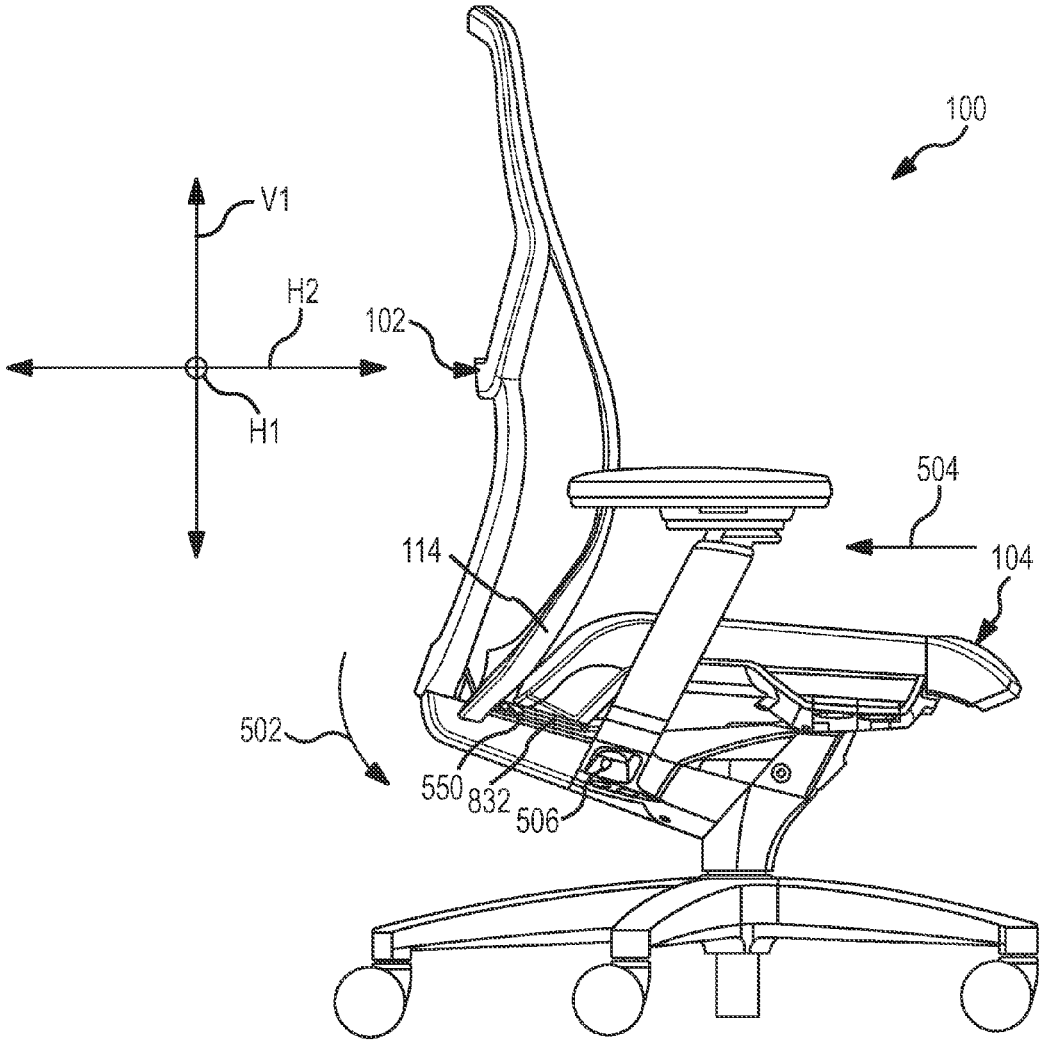
FIG. 5 illustrates another side view of the chair of FIGS. 1-4, according to embodiments of the present invention.
Figure 6:
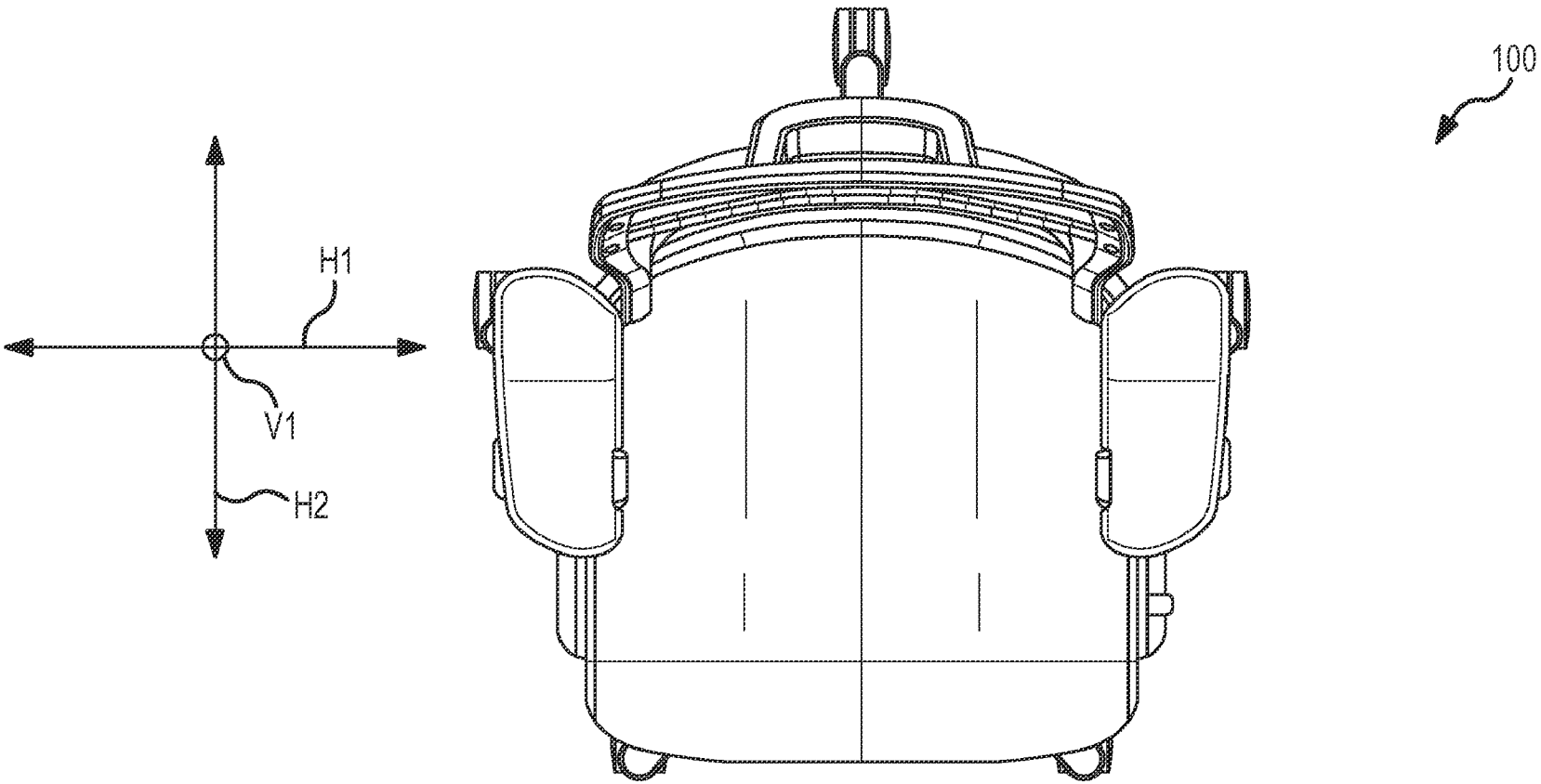
FIG. 6 illustrates a top view of the chair of FIGS. 1-5, according to embodiments of the present invention.
Figure 7:
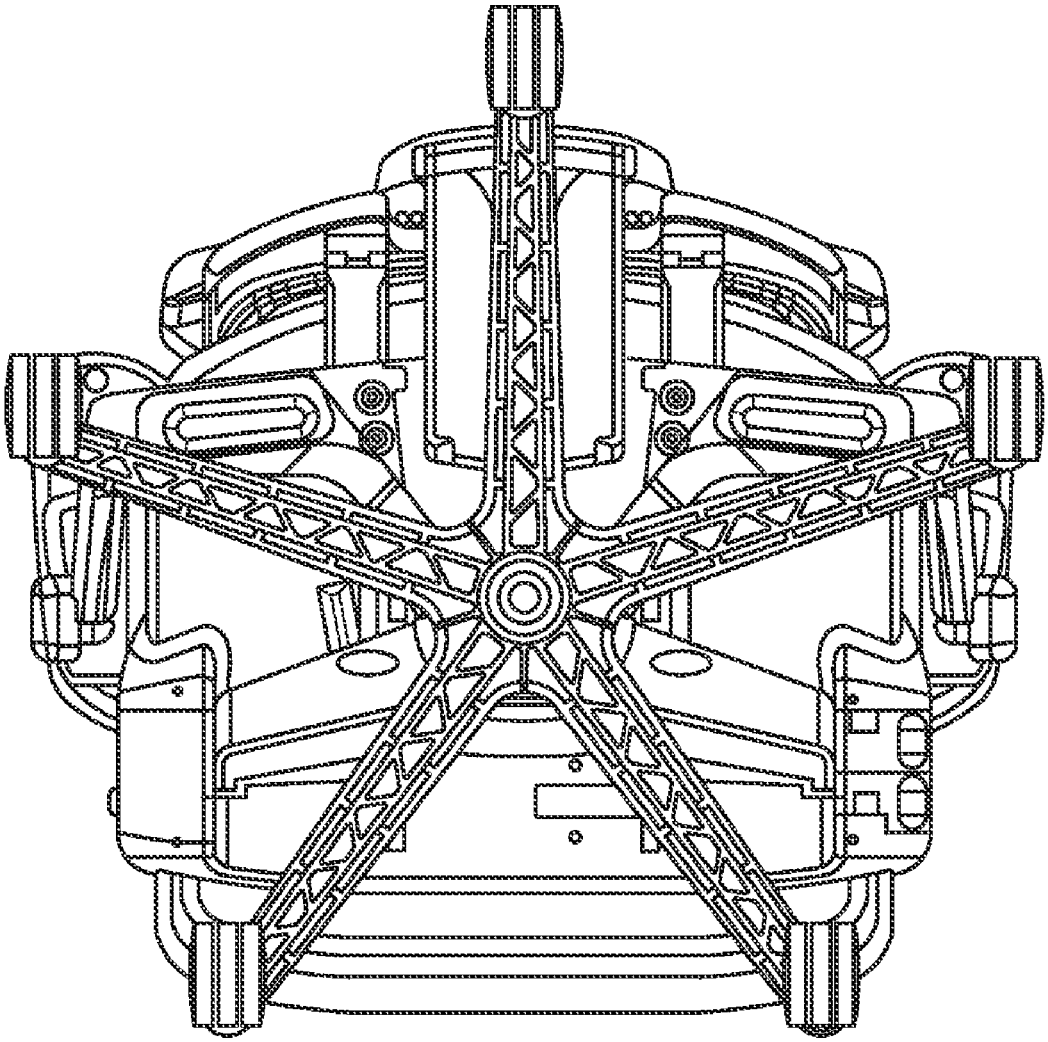
FIG. 7 illustrates a bottom view of the chair of FIGS. 1-6, according to embodiments of the present invention.

As used herein, the terms "horizontal," "horizontally," and the like are used in their broadest sense to refer to a direction along or parallel to a plane relative to a chair 100, where such plane is defined by the lines H1 and H2 depicted in FIGS. 2, 5 and 6. Although lines H1 and H2 are not shown in all views, the plane defined by H1 and H2 in FIGS. 2, 5 and 6 serves to define such plane in all views as such plane is defined relative to chair 100. As used herein, the terms "vertical," "vertically," and the like are used in their broadest sense to refer to a direction along or parallel to a line relative to a chair 100, where such line is defined by the line V1 of FIGS. 2, 5 and 6. Although line V1 is not shown in all views, line V1 serves to define such line in all views as such line is defined relative to chair 100.

As illustrated in the side view of FIG. 5, back 102 reclines and/or rotates in a direction generally indicated by arrow 502 about a pivot point generally indicated at 506, when user pushes against back 102. This rotation of back 102 in direction 502 causes seat 104 to slide generally towards the back 102 in a direction indicated by arrow 504, as well as generally upwardly. According to embodiments of the present invention, the seat 104 does not move at the same rate as the back 102 during reclination; in other words, the back 102 and seat 104 do not form a simple "L" shape which simply tilts backwardly during reclination.

Figure 8:
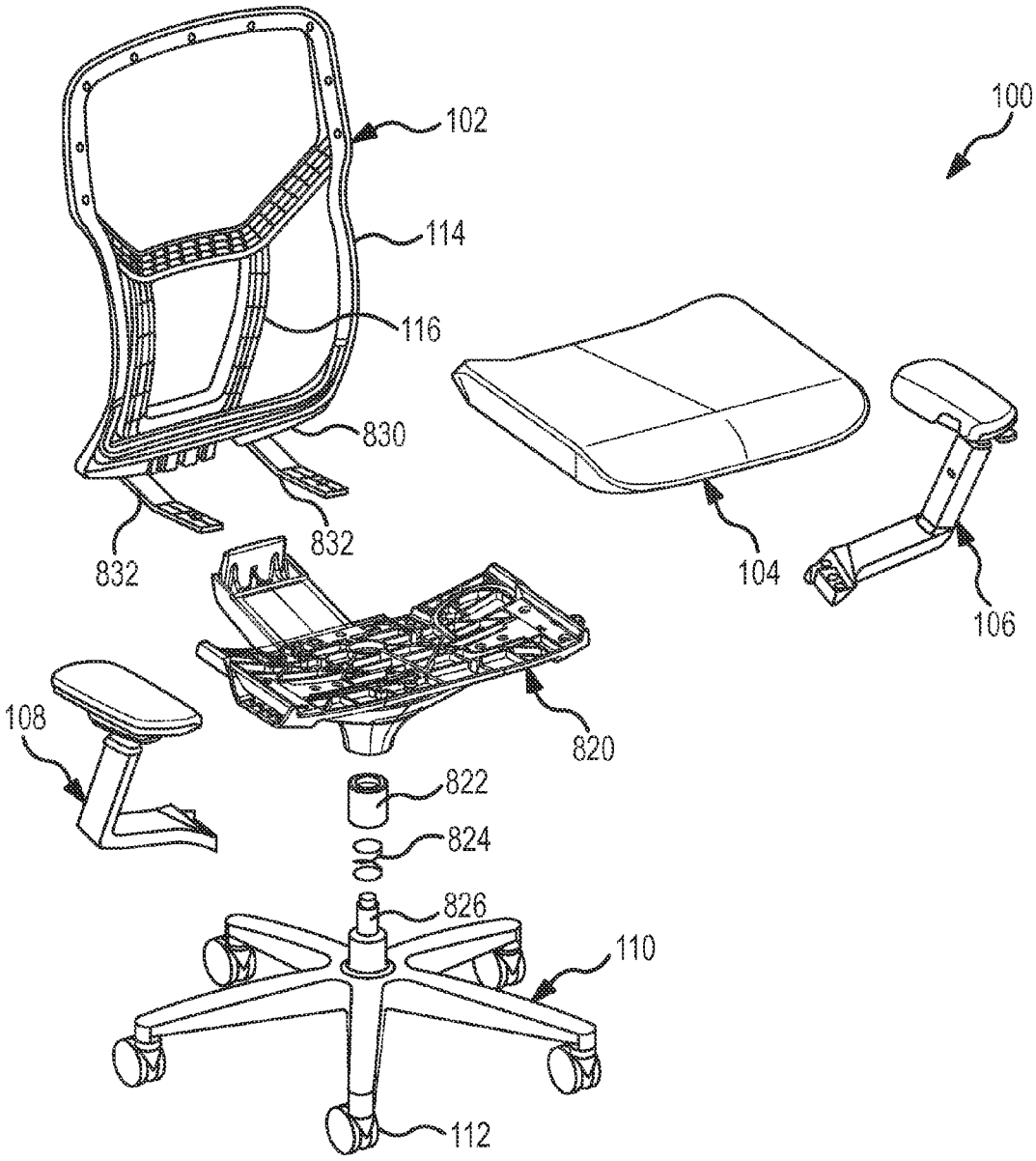
FIG. 8 illustrates an exploded perspective view of the chair of FIGS. 1-7, according to embodiments of the present invention.

FIG. 8 depicts an exploded view of chair 100 including back 102, seat 104, left arm 106, right arm 108, pedestal 110, casters 112, and core assembly 820, which are coupled to form chair 100. Core assembly 820 is coupled with pedestal 110 via a hydraulic piston 826 which permits core assembly 820 to rotate about pedestal 110 and which permits the height of core assembly 820 to be adjusted with respect to pedestal 110. Sheath 822 may be included between core assembly 820 and pedestal 110 to cover and protect hydraulic piston 826 and/or spring 824. Spring 824 may be included between core assembly 820 and pedestal 110 in order to supply an upwardly-biased force to raise sheath 822 as core assembly 820 is lifted by hydraulic piston 826, according to embodiments of the present invention. As used herein, the terms "base" and "chair base" are used in their broadest sense to refer to an element or elements about which the back 102 reclines. According to some embodiments of the present invention, the base of chair 100 may be a component of core assembly 820 about which the other components and/or linkages move or rotate; for example, the base may be the element of core assembly 820 which interfaces directly with the piston 826 and the other elements which are rigidly coupled to such element. In other words, the base of chair 100 may be, in kinematic terms, the "ground link" near the seat to which the other links are coupled, according to embodiments of the present invention.

Figure 9:
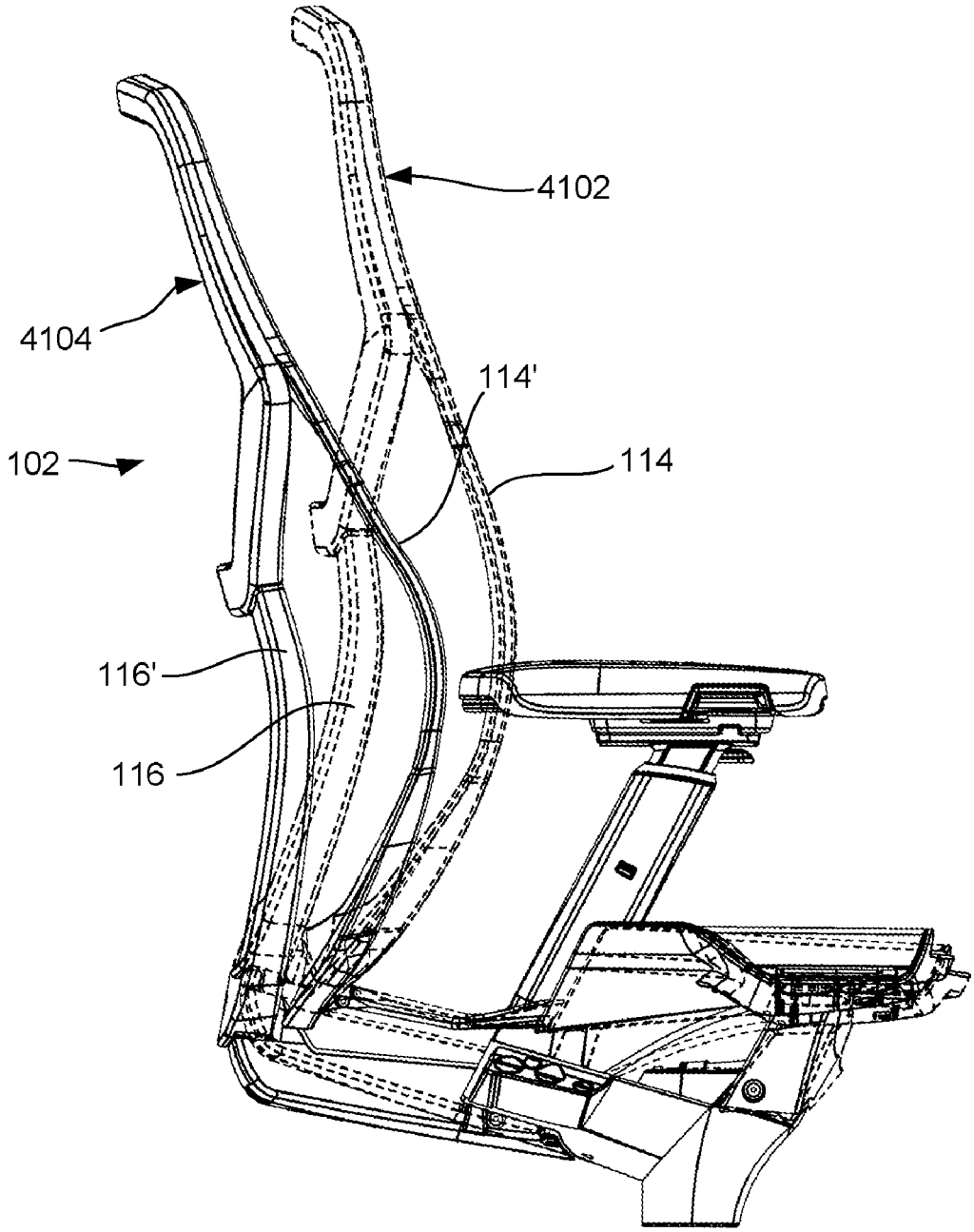
FIG. 9 illustrates a side view of the chair of FIGS. 1-8 with an upright position in broken lines superimposed upon a reclined position in solid lines, according to embodiments of the present invention.

FIG. 9 illustrates a chair back 102 in an upright position 4102 in dotted lines superimposed upon a chair back 102 in a reclined position 4104 in solid lines. Generally, a user's back undergoes an increasing amount of curvature as a chair back 102 is progressed through an increasing degree of reclination, and/or the user's back requires greater support in the lumbar region as the chair back 102 is progressed through an increasing degree of reclination. Embodiments of the present invention seek to add to the user's comfort during reclining by more closely matching movement of chair back 102 to the movement and/or support requirements of a user's back, and by minimizing misalignment of the user's back with respect to back 102.

As seen in FIG. 8, core assembly 820 includes one or more springs or seat attachment members 832 coupling the back of core assembly 820 to back 102. Such springs 832 may be rigid or semi-rigid springs, and may be coupled to a seat plate such that their movement follows any movement of the seat 104, according to embodiments of the present invention. The outer frame 114 may include one or more lower pads 830. According to some embodiments of the present invention, the seat 104 remains stationary as the back 102 reclines, thereby also creating a curvature of the frame 114 based on the relative motion of the back 102 with respect to the seat 104. According to some embodiments of the present invention, the frame 114 may be coupled directly or indirectly to a stationary seat 104 and/or to another element which does not move with respect to the back 102; for example, the frame 114 may be coupled to a portion of the core assembly 820 which, as the back 102 reclines, has a different relative motion in order to create an increasing curvature of the frame 114 as the back 102 reclines.

According to embodiments of the present invention, springs 832 are affixed to a seat plate of the core assembly 820 on one end, and are rotatably coupled to pads 830 at the other end. According to such embodiments, the lower end of outer frame 114 (e.g. pads 830) travels along with seat 104 during reclining, which causes the outer frame 114 to exhibit a greater degree of bending and/or curvature during reclining, particularly in chairs 100 in which the seat 104 moves at a different rate from the back 102 during reclining. FIG. 9 conceptually illustrates the different curvature of outer frame 114' upon reclining to position 4104 when outer frame 114' is rotatably coupled to support member 116 (e.g. via pads 830), according to embodiments of the present invention. According to such embodiments, outer frame 114' exhibits a curvature (e.g. in the lumbar region) which increases as the chair 100 is reclined, just as the curvature of a user's back increases as the user's back moves with the reclining back 102.

Although embodiments of the present invention illustrate the use of dual springs 832 rotatably coupled with dual pads 830, other embodiments of the present invention include a single spring 832 rotatably coupled with a single pad 830 and/or directly with the outer frame 114. Yet other embodiments include two or more springs 832 rotatably coupled with two or more pads 830, and/or a rotatable coupling directly between seat 104 and/or seat support members and outer frame 114. According to some embodiments of the present invention, a non-rotatable coupling may be used between outer frame 114 and spring 832, which still permits movement of outer frame 114 with seat 104 instead of with back 102.

Figure 10:
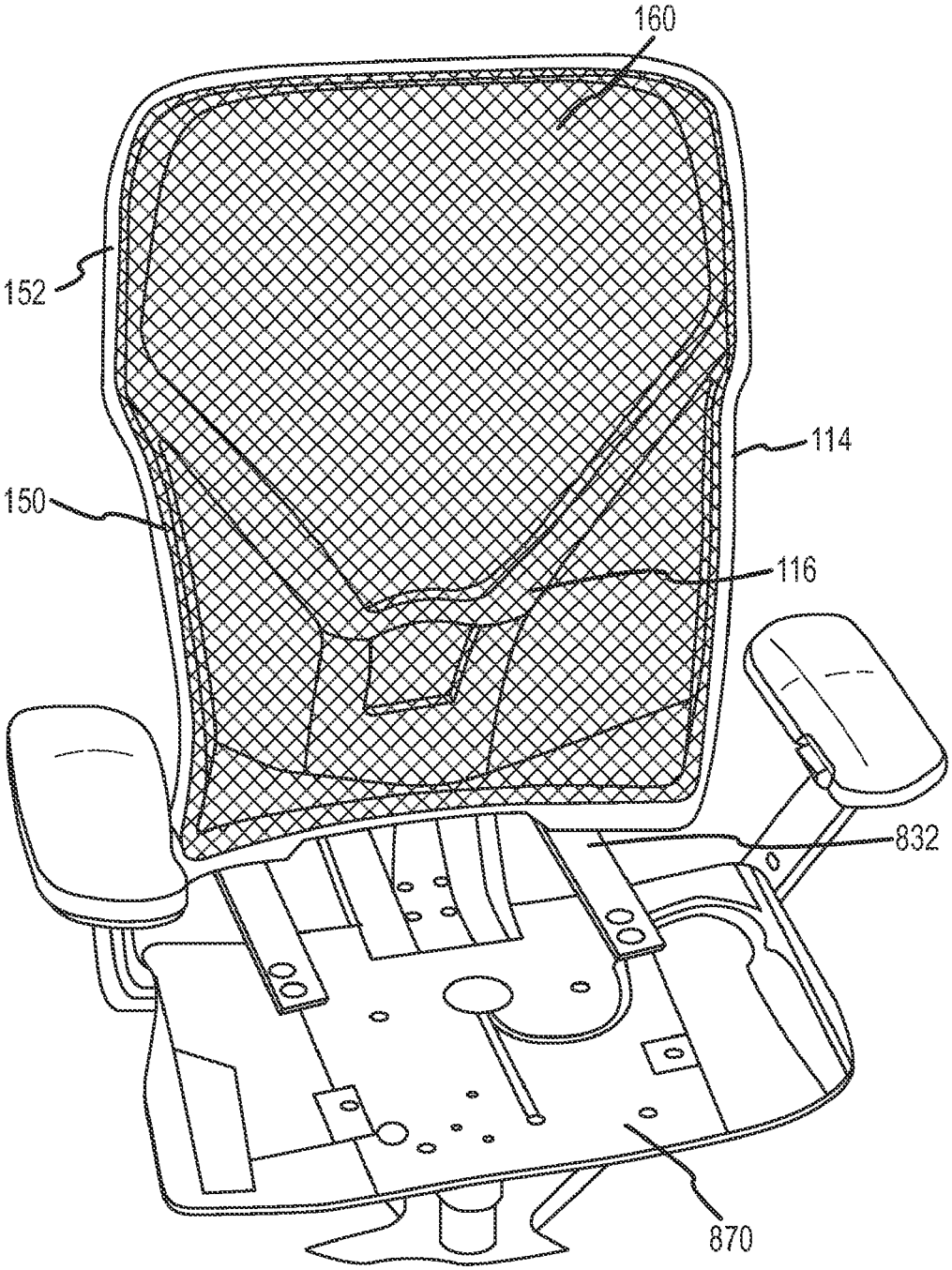
FIG. 10 illustrates a front perspective view of a chair and back according to embodiments of the present invention.
Figure 11:
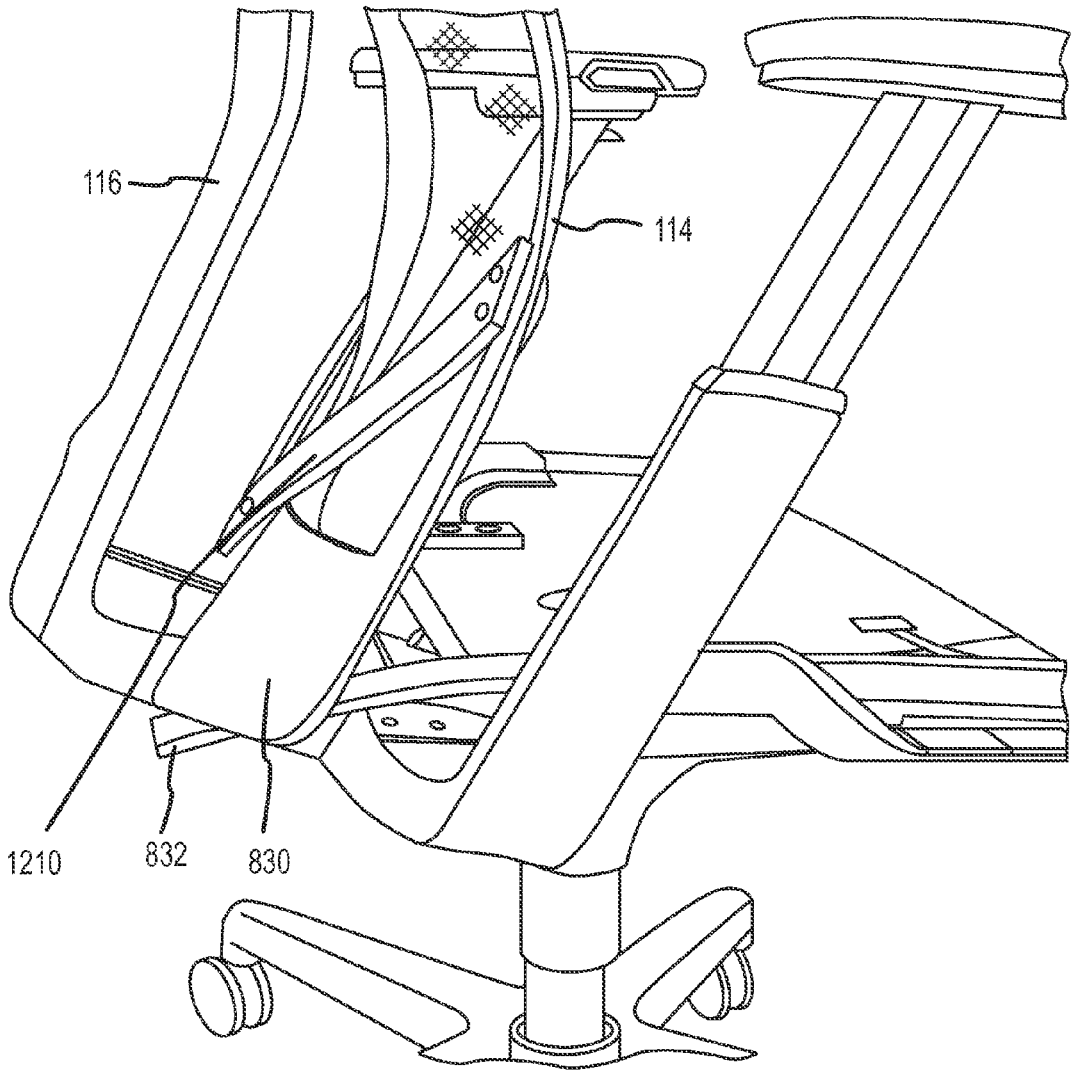
FIG. 11 illustrates a side view of a chair back whose shape changes dynamically throughout reclination, according to embodiments of the present invention.

FIG. 10 illustrates a front perspective view of a chair and back according to embodiments of the present invention. FIG. 11 illustrates a side view of a chair back whose shape changes dynamically throughout reclination as the base is held steady, according to embodiments of the present invention. FIG. 11 depicts the chair back toward the beginning of reclination, according to embodiments of the present invention. As can be seen in FIG. 11, the shape of the outer frame 114 and thus the mesh and/or fabric extending therebetween changes during reclining, to provide increased curvature and/or lumbar support during reclining. A center support member 1210, such as, for example, a V-shaped support member, may optionally be used to span the left and right sides of outer frame 114 to maintain any desired separation between the left and right sides of outer frame 114 and thus to provide a desired level of support, according to embodiments of the present invention.

FIG. 10 illustrates a chair with a seat 870, seat attachment members 832, a flexible frame member 114 having a first portion 152 attached to the rigid support member 116 and a second portion 150 that is free to flex with respect to the rigid support member 116, according to embodiments of the present invention. A mesh or mesh fabric 160 at least partially spans the frame 114, according to embodiments of the present invention. As illustrated in FIG. 5, the point 550 at which the flexible frame member 114 contacts the seat attachment member 832 may include various forms of coupling, according to embodiments of the present invention. According to some embodiments of the present invention, the seat attachment member 832 is merely in contact with the flexible frame member 114 at contact area 550 to create increasing curvature in the flexible frame member 114 as the back 116 reclines. According to other embodiments of the present invention, the seat attachment member 832 is pivotably coupled with the flexible frame member 114 at pivot point 550. According to yet other embodiments of the present invention, the seat attachment member 832 is rigidly coupled with the flexible frame member 114 at coupling point 550. Alternatively, the seat attachment member 832 may be formed integrally with the seat 870 and/or with the flexible frame member 114, according to embodiments of the present invention. According to some embodiments of the present invention, the pivot or coupling point or points 850 may be located at any location along flexible frame member 114 which permits the flexible frame member 114 to curve as the back 116 reclines; as such, the location at which the flexible frame member 114 attaches to the seat 104, the seat attachment member 832, and/or another chair element need not be only along the sides or bottom perimeter of flexible frame member 114.

According to some embodiments of the present invention, outer frame 114 may be constructed with a thermoplastic elastomer such as, for example, a Dupont Hytrel material. Outer frame 114 may thus provide support to a user's back while being flexible enough to assume a more curved position while the chair is reclined. The support member 116 may be constructed with aluminum and/or a glass-filled nylon, according to embodiments of the present invention. The mesh installed across the outer frame 114 and against which a user's back rests may be constructed with Dupont Hytrel and polyester fibers, or other elastomeric materials, according to embodiments of the present invention. The springs 832 may be constructed with an acetal copolymer, such as, for example a Ticona Celcon acetal copolymer, according to embodiments of the present invention.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A chair, comprising:

a rigid support member configured for reclinable attachment to a chair base;

a flexible frame member comprising a flexible frame and a mesh element, the mesh element at least partially spanning the flexible frame and the flexible frame having a top area and a bottom area and defining a first portion toward the top area and a second portion toward the bottom area; and at least one seat attachment member coupled to a seat, the seat attachment member comprising an attachment portion that is elongate in a forward and backward direction corresponding generally to a sitting direction, the seat moving in synchronization with the rigid support member at a different rate than the rigid support member during reclining of the rigid support member, wherein the first portion of the flexible frame member is affixed to the rigid support member, wherein the second portion of the flexible frame member flexes freely with respect to the rigid support member, wherein the at least one seat attachment member contacts at least part of the second portion of the flexible frame member, wherein the first portion moves with the rigid support member and the at least part of the second portion moves with the seat attachment member such that a degree of curvature of the second portion increases as the rigid support member reclines, the bottom area of the flexible frame being coupled to the at least one seat attachment member at a flexible frame contact position and the rigid support member being affixed to the at least one seat attachment member at a rigid support member contact position that is located behind the flexible frame contact position when the rigid support member is in both upright and reclined positions, wherein the flexible frame contact position and the support member contact position are on the attachment portion of the at least one seat attachment member.

2. The chair of claim 1, wherein the at least one seat attachment member is formed integrally with the flexible frame member.

3. The chair of claim 1, wherein the flexible frame is an outer frame, and wherein the mesh element is configured to contact a user's back.

4. The chair of claim 1, wherein the second portion of the flexible frame member is configured to provide support to a lumbar region of a user's back.

5. The chair of claim 1, wherein the second portion of the flexible frame member dynamically adjusts to match increasing curvature of a user's lumbar back region during reclining.

6. The chair of claim 1, wherein the seat attachment member is a spring.

7. The chair of claim 1, wherein the flexible frame member is rigidly affixed to the rigid support member.

8. The chair of claim 1, wherein the flexible frame member contacts the rigid support member only at the first portion, and contacts the seat only at the bottom area.

9. A chair, comprising:

a rigid support member configured for reclinable attachment to a chair base;

a flexible frame member positioned in front of the rigid support member, the flexible frame member comprising a flexible frame spaced in front of the rigid support member and a flexible covering for contacting a person's back, the flexible frame having an upper portion affixed to the rigid support member and a lower portion spaced from the rigid support member and defining a first convex profile in an upright position and being configured to flex freely with respect to the rigid support member to define a second convex profile in a reclined position, the flexible covering spanning the flexible frame and being configured to be maintained by the flexible frame at the first and second convex profiles for supporting a person's lumbar region; and a seat attachment member comprising an attachment portion that extends generally longitudinally in a forward and backward direction corresponding to a sitting direction, the attachment member coupled to the lower portion of the flexible frame member at a first point, and coupled to the rigid support member at a second point located rearwardly of the first point when the rigid support member is in both upright and reclined positions such that the upper portion moves with the rigid support member and the lower portion moves with the seat attachment member such that a degree of curvature of the second portion increases as the rigid support member reclines, wherein the first point and the second point are on the attachment portion of the seat attachment member; and a seat coupled to the seat attachment member.

10. The chair of claim 9, wherein the flexible covering includes a mesh element at least partially spanning the flexible frame member.

11. The chair of claim 9, wherein the flexible covering includes a polymer element at least partially spanning the flexible frame member.

12. The chair of claim 9, wherein the seat attachment member is a spring.

13. The chair of claim 9, wherein the flexible frame member contacts the rigid support member only at the first portion of the flexible frame member, and contacts the seat attachment member only at a bottom area of the flexible frame member.

14. The chair of claim 9, wherein the flexible frame member is rigidly affixed to the rigid support member.

* * * * *

UNITED STATES PATENT AND TRADEMARK OFFICE

CERTIFICATE OF CORRECTION

PATENT NO. : 8,251,448 B2
APPLICATION NO. : 12/048113
DATED : August 28, 2012
INVENTOR(S) : Jay Richard Machael et al.

It is certified that error appears in the above-identified patent and that said Letters Patent is hereby corrected as shown below:

In the Claims

Column 8, Line 21

Replace the words “second portion” with -- lower portion --

Signed and Sealed this
Twelfth Day of May, 2015

Michelle K. Lee

Michelle K. Lee
*Director of the United States Patent and Trademark Office*